US006701948B2

(12) United States Patent
Jopp et al.

(10) Patent No.: US 6,701,948 B2
(45) Date of Patent: Mar. 9, 2004

(54) PORTABLE SHELTER'S MODULAR SHELL INCLUDING DISPLACEABLE/ CONNECTABLE WALLS

(76) Inventors: Brian David Jopp, 10550 Fannun Ave. SE., Delano, MN (US) 55328; Bobby D. Jopp, 11402 150$^{th}$ Ave., Little Falls, MN (US) 56345

( * ) Notice: Subject to any disclaimer, the term of this patent is extended or adjusted under 35 U.S.C. 154(b) by 0 days.

(21) Appl. No.: 10/002,375

(22) Filed: Nov. 24, 2001

(65) Prior Publication Data

US 2002/0062852 A1 May 30, 2002

Related U.S. Application Data

(60) Provisional application No. 60/252,981, filed on Nov. 24, 2000.

(51) Int. Cl.$^{7}$ ..... E04H 15/36

(52) U.S. Cl. ..... 135/97; 135/115; 52/222

(58) Field of Search ..... 135/97, 95, 133, 135/115, 119, 120.4; 52/83, 222

(56) References Cited

U.S. PATENT DOCUMENTS 3,802,133 A * 4/1974 Gregory ..... 52/86
4,766,919 A * 8/1988 Crates ..... 135/97
4,800,597 A * 1/1989 Healey ..... 4/599
5,069,623 A * 12/1991 Peat ..... 434/260
5,222,513 A * 6/1993 Hilliard ..... 135/97
5,368,057 A 11/1994 Lubkeman
5,620,396 A * 4/1997 Westphal ..... 482/35
6,273,114 B1 * 8/2001 Schaefer ..... 135/128

* cited by examiner

*Primary Examiner*—Carl D. Friedman
*Assistant Examiner*—Basil Katcheves

(57) ABSTRACT

An outdoor modular shelter shell with simplified connection system comprises a flexible covering having a central portion which overlays a supporting frame. Four displaceable/ connectable side panels extend from the central portion to form an enclosure. A tail fastener/wall fastener connection system allows the user to completely displace walls and connect a plurality of shells to form a one room weather proof outdoor shelter with no restrictions between connected shells. Various individual wall panels may be added to transform the shelter from a fishing shelter to a hunting blind. The simplified connection system is very easy to use even with a gloved hand under low light conditions and provides a strong, weather tight, aesthetically pleasing, economical joint between the walls of an individual shelter or a plurality of connected shelters.

4 Claims, 4 Drawing Sheets

20
22
24
26
28
30
32
34
36
38
40
54
56

PORTABLE SHELTER'S MODULAR SHELL INCLUDING DISPLACEABLE/ CONNECTABLE WALLS

CROSS REFERENCES TO RELATED APPLICATIONS

This application claims the benefit of Provisional Patent Application Ser. No. 60/252,981 filed Nov. 24, 2000.

BACKGROUND—FIELD OF INVENTION

This invention relates to outdoor modular shelter shells; specifically to an improved connection system for connecting one outdoor shelter to another outdoor shelter or multiple outdoor shelters.

BACKGROUND—DESCRIPTION OF PRIOR ART

Portable shelters are used in a number of different fields: fishing, hunting, camping and construction. Outdoor portable shelters such as tents, ice fishing houses, utility huts, hunting blinds and bird blinds have been used to provide temporary shelter and protection from the cold, wind, snow, biting insects, and other outdoor elements for workers and outdoor enthusiasts for many years. Aside from protecting the user from outdoor elements, modern day shelters should be quick to set-up and portable. To be portable there weight and size is usually kept relatively small to enable the individual user to easily transport, set-up, and take-down the shelter by oneself. This size limitation doesn't allow groups of people to work or socialize comfortably as the relatively small volume can easily become crowded and inefficient.

The need for larger spaces or volumes allowing groups of people to socialize and gather within had led to the creation of larger outdoor shelters that are not so portable and more recently to the concept of outdoor modular shelters that may be connected to one another to form a larger space.

Originally outdoor modular shelters used additional flaps, fasteners, or tunnel like appendages to make a weather tight connection between two structures. For example U.S. Pat. No. 5,368,057 required additional door flaps and an exterior fastening system to be sewn permanently on to the exterior of the original structure to provide the mechanism for linking two units together.

While these flaps may provide a means for linking two shelters together they also add materials and thus weight to what is to be a portable light-weight structure, add cost due to the increase in materials and labor needed to manufacture, may not be very aesthetic, are cumbersome to use, and the added flaps and fasteners serve no purpose when units are not being connected together.

Also hook and loop type fasteners sewn to the outside of the shelter that are not in use are likely to attract snow, ice, and foreign debris thereby lessening it's connective properties and also giving the outdoor shelter an unsightly appearance.

Additionally connection systems located on the exterior of the shell require the user to operate the fastener from the exterior of the shell where they will be exposed to the very outdoor elements that the shelter is to be protecting them from.

Connection systems like this that do not connect at the face of the exterior wall form pockets between the connected outdoor shelters that collect wind thus jeopardizing the connection itself.

Additionally structures using this type of connection system do not completely displace the wall on the shared side when two units are connected together but rather connect the two units via a restricted opening within each of the walls shared by the two connected units. Shelters linked together by using this method of flaps and or tunnels essentially result in two rooms that are linked together by a doorway made up of this flap and tunnel connection system; therefore the users do not enjoy the benefits of being in one room or space when conversing, working, or participating in outdoor social activities from within the combined outdoor modular shelters.

Outdoor modular shelters when connected together or used as separate units in the out-of-doors must provide protection against the elements. This requires that the connection system be easy to use and provide a continuous weather tight joint when the shelters are either connected together or being used independently. For example connection systems for outdoor modular shears being used for fishing on the ice must: provide a weather tight joint to protect the occupant from outdoor temperatures well below zero degrees Fahrenheit, strong winds, and associated dangerous windchills. Furthermore, if the angler is spearing the shelter and its connection system must not allow any outside light to penetrate into the shelter or the angler will not be able to see into the water and therefore not be able to spear any fish.

Not only does the connection system have to be strong and weather tight, it also needs to be simple and easy for the angler to use. If, for example, they are fishing at night under low visibility conditions in addition to using a gloved hand to protect themselves from frost bite when connecting or disconnecting two or more units.

In the past, users of outdoor modular shelters have had to purchase multiple shelters for a particular use. For example, an outdoorsmen might use a hunting blind with a transparent wall that allows him to be camouflaged within while also permitting him to see out and shoot through the wall for the taking of game animals in the fall. Later in the season, the same person would use a spear house with it's heavy duty, opaque shell to keep the elements and light out of the shelter when spearing fish on the ice. Obviously having to buy and maintain multiple shelters for various uses is costly and can take up a lot of storage space during the off-season.

What is needed is a outdoor modular shelter shell with a connection system that provides:

(a) A connective/removable wall characteristic that allows total displacement of a wall or walls thereby providing unrestricted movement and communication amongst its users within connected outdoor modular shelters.

(b) An internal connection system that can be operated by the user from within the shelter thereby protecting the user from the elements even when making connection or disconnection to another unit.

(c) The opportunity to displace one type of wall surface and replace it with another surface thus enabling the outdoor modular shelter shell to be used for multiple purposes.

(d) Simple, easy, and trouble free connecting or disconnecting properties such that the connection system can be operated with a gloved hand under extreme conditions of low temperatures and visibility.

(e) A reduction in the materials, labor, and time needed to manufacture the outdoor modular shell thereby reducing cost.

(f) A reduction in the materials needed to manufacture the outdoor modular shell thereby increasing portability.

(g) A weather, biting insect, and even a light proof joint between walls that are connected together.

(h) An aesthetically pleasing and functional design that will not collect foreign material or debris at the fastener itself when not in use.

(i) A design that will not form wind pockets between connected walls of connected outdoor shelters thereby jeopardizing the integrity of the connection.

SUMMARY

In accordance with the present invention a outdoor modular shelter shell with simplified connection system comprises a flexible covering manufactured of flexible fabric having a central portion which is dimensioned to overlay a base and a supporting pole system. Four displaceable/connectable side panels extend from the central portion and are dimensioned to generally extend the height and width of the base and the supporting pole system so as to form an enclosure. A tail fastener manufactured of hook/loop fastening material is permanently connected at one end to each of the top four corners of the interior of the enclosure and is dimensioned to generally extend the height of the enclosure. A wall fastener manufactured of hook/loop fastening material and opposite that of the tail fastener material is permanently attached to each interior vertical edge of the side panels and is dimensioned to generally extend the height of the enclosure with a width that is generally half the width of the tail fastener. The corners of the enclosure are each connectable through the entire height of the enclosure by connecting both of the adjacent wall fasteners to the respective half of the shared tail fastener to form a weather tight joint.

Also, the shell has been given other characteristics such as a weather flap(s) at the base of the side panel, a anchor strap(s), a reinforcement strip(s), a square fastener(s), a window with a light proof shutter, a door, and a mesh pocket.

OBJECTS AND ADVANTAGES

Accordingly besides the objects and advantages of the outdoor modular shelter shell with simplified connection system described in my above patent, several objects and advantages of the present invention are:

(a) a connective/removable wall characteristic that allows total displacement of a wall or walls thereby providing unrestricted movement and communication amongst its users within connected outdoor shelters;

(b) an internal connection system that can be operated by the user from within the shelter thereby protecting the user from the elements when making connection or disconnection to another unit;

(c) the opportunity to displace one type of wall surface or side panel and replace it with another surface thus enabling the outdoor modular shelter shell to be used for multiple purposes like hunting and fishing;

(d) simple, easy, and trouble free connecting or disconnecting properties such that the connection system can be operated with a gloved hand under extreme conditions of low temperatures and visibility;

(e) a reduction in the materials, labor, and time needed to manufacture the outdoor modular shell thereby reducing cost while;

(f) a reduction in the materials needed to manufacture the outdoor modular shell thereby increasing portability;

(g) a weather, biting insect, and even a light proof joint between walls that are connected together;

(h) an aesthetically pleasing and functional design that will not collect foreign material or debris at the fastener itself when not in use; and (i) a design that will not form wind pockets between connected walls of connected outdoor shelters.

Further objects and advantages are the following:

The weather flap prevents wind from moving into the shelter to ensure warmth for the user. The weather flap repels water and directs it away from the inside of the shelter. The weather flap becomes a barrier, protecting the flexible covering from becoming a "wick". Upon rolling up a wall, the weather flap permits the user to "tightly" roll the flap up. While using the flexible covering for spearing, the weather flap prevents light from entering into the shelter which is necessary for the angler's visibility for spearing activities.

The reinforcement strip's function is to strengthen the anchor system. This reinforcement strip prevents the flexible covering from being damaged during adverse weather conditions. Without the strip, the anchors may tear the flexible covering. The purpose of a temporary shelter is to keep the user from being exposed to harsh or non-pleasurable conditions. Basically, the reinforcement strip makes this possible even during the harshest conditions because the shell becomes more durable.

The tail fastener allows adjacent walls to be connected in any configuration. Presently, it is either a hook or loop system, but it could be a snap, zipper, or other type of fastening mechanism and/or a combination thereof The tail fastener makes it possible to eliminate doors altogether. Without the tail fastener, connection to any wall would require additional connective material. For example, all of the sides would require a hook and loop.

The tail fastener makes it possible to connect other material to the flexible covering. Following are some examples. A screen might be the desired material on a hot day while camping. While hunting, there is a material that is made to shoot through it; this could be attached to save on cost. In the construction field, the wall might need to be removed to bring in equipment. Furthermore, the equipment might require more space. There be a need to add on modules until the right dimension is needed. For safety reasons, regardless of hunting, fishing, construction, or camping, access in and out is on all sides.

The wall fastener is attached to the walls and connects to the tail fastener. Using the hook and loop system, it easily disconnects and connects. Also, it prevents wind and light from entering the chamber.

The square fastener allows a detached wall to be secured at the top of the shell. This is very time saving. One only needs to flip the material over the top and press the hook into the loop. It prevents the side from being lost or damaged keeping it out of the way of the user.

The window helps light inside when the user needs more light. However, if the user does not want light, a shutter with a hook and loop system can be placed and secured to prevent light from entering.

Anchor straps also utilizing the hook and loop system are placed so that the covering is adjustable. This prevents a "whipping" effect and permits the material from ripping during windy conditions. The anchoring system can make up differences in material/framework length because it can be adjusted. There are other systems that would work as well. For example, a pull chord that tightens when pulled but can be loosed by pushing a button would work as well. However, the hook and loop system is cost effective and universal throughout the whole flexible covering.

The double zipper allows the door to be opened for entry, and it can be used as a ventilation system for the user.

A mesh pocket has been added to the covering for storage of various items to easily access.

All materials compounded makes this product lightweight, easily transportable, and space efficient. Regardless of activity, being lightweight is always considered: this patent makes it pliable to diversify in all fields, yet take advantage of all the aspects of connectability/displaceability. Being modular, it can be transportable, yet yield a huge volume. Space efficiency once again lends itself to the modular design of the encompassing patent: individual hikers; various additions needed in construction; social aspects of connecting, disconnecting, and association of peoples, and non-restrictive materials (flexible covering) but unique design. So, any space requirement can be solved via the connectivity feature.

Still further objects and advantages will become apparent from a consideration of the ensuing description and accompanying drawings.

REFERENCE NUMERALS

Figure 3:
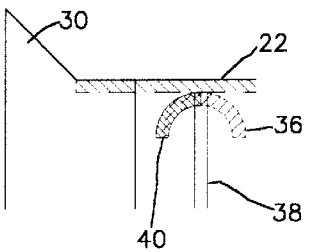
FIG. 3 is a plan view of the shell anchors, reinforcement strip, and weather flap.
Figures 4, 5:
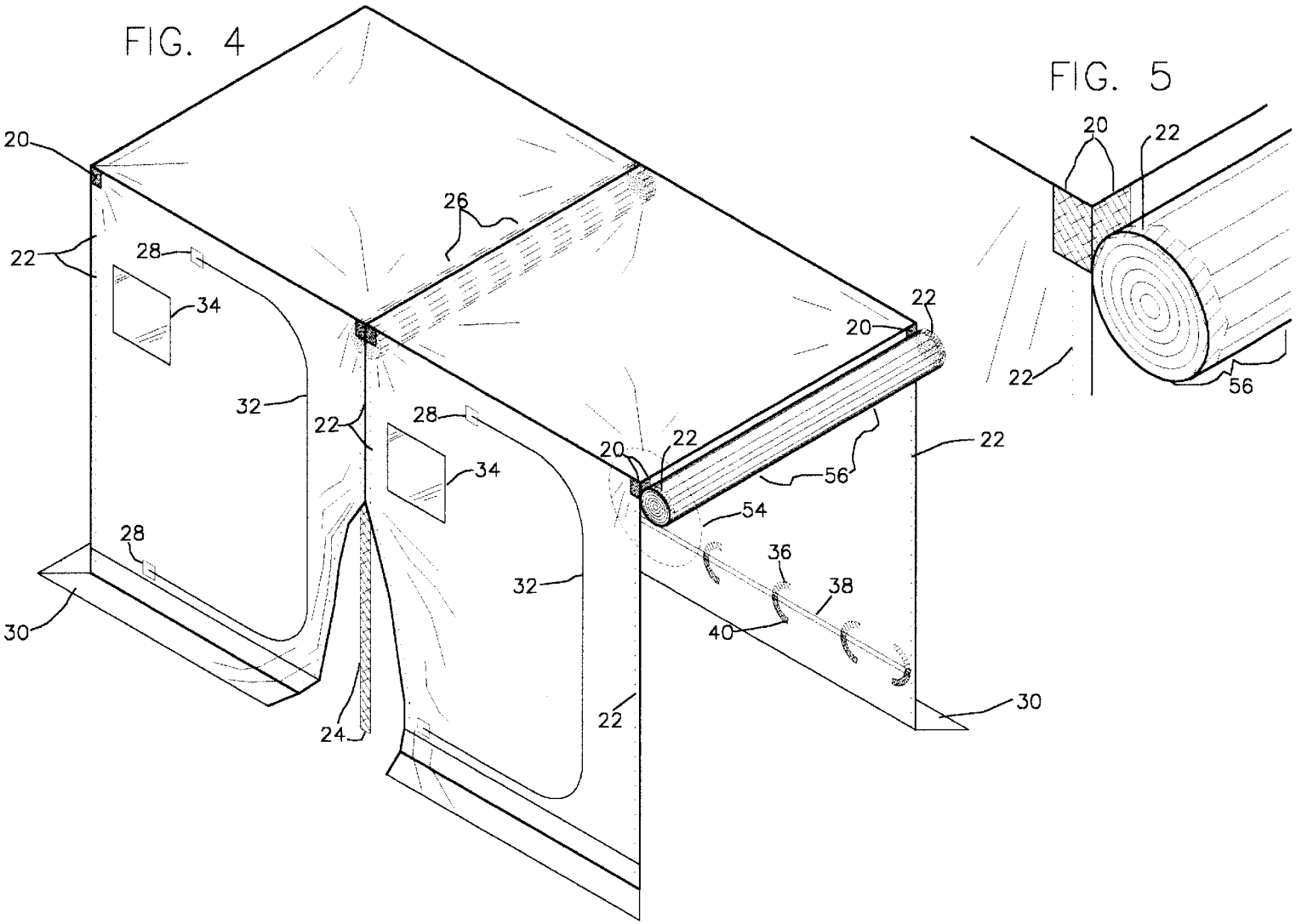
FIG. 4 is a perspective view of two units partially connected and one displaced.
FIG. 5 is a perspective view of one way to anchor walls when displaced.

20 Square fastener
22 Wall Fastener
24 Tail Fastener
26 Roll Connection
28 Square Reinforcement
30 Weather Flap
32 Zipper
34 Window
36 Anchor Strap (Hook)
38 Reinforcement Strip
40 Anchor Strap (Loop)
42 FIG. 3
44 Loop Strip for Window Shutter
46 Hook Strip for Window Shutter
48 Window Shutter
50 Mesh Pocket
52 Seam for top of side
54 FIG. 5
56 Displaced Single Wall
58 Flexible Covering

PREFERRED EMBODIMENT—DESCRIPTION

Figure 6:
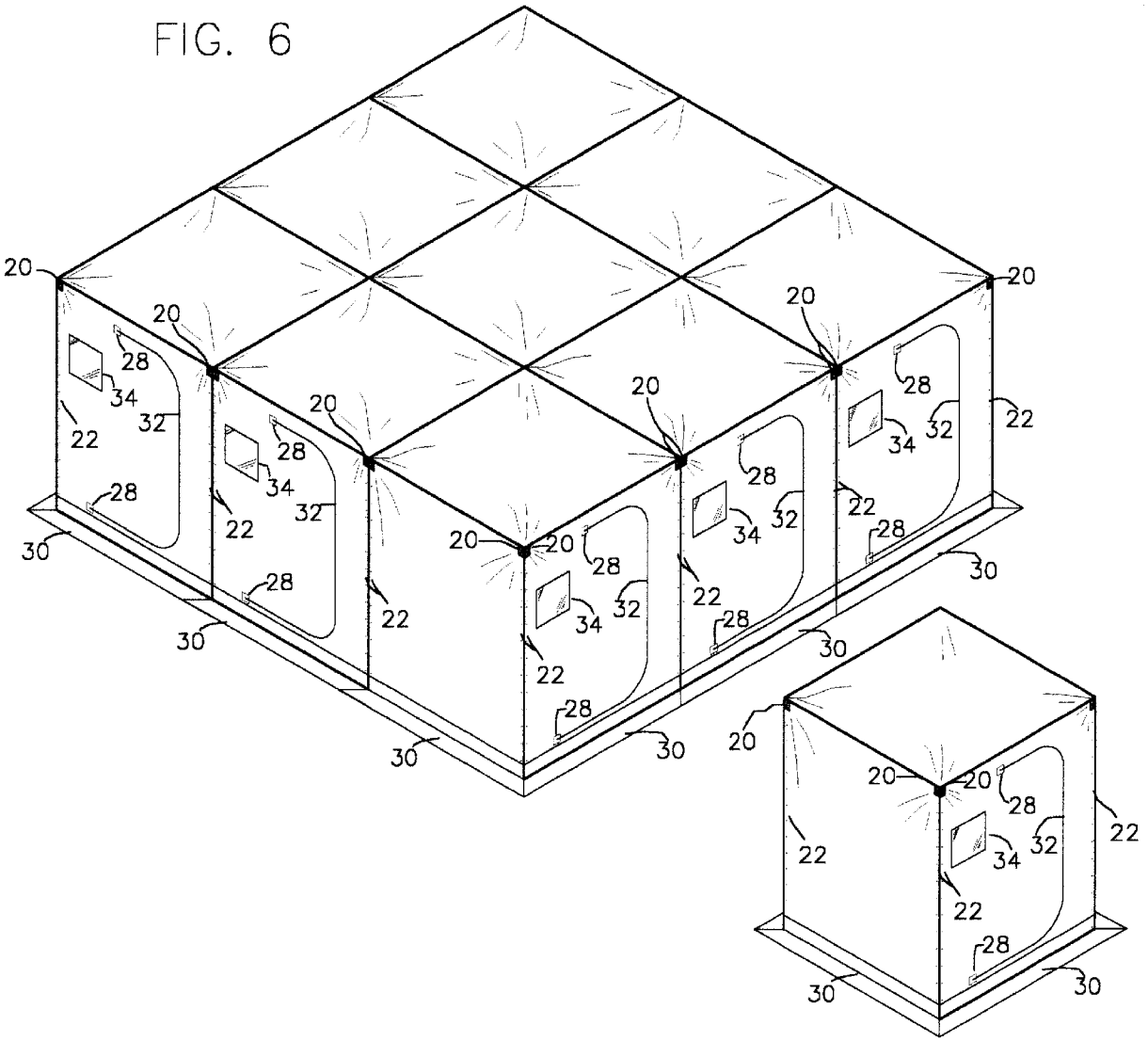
FIG. 6 is a perspective view of nine units connected at various walls and a single unit.

A preferred embodiment of the outdoor modular shelter shell of the present invention is illustrated in FIG. 6 a perspective view of a single shell in the foreground with nine shells connected to together in the background showing that these shells can be connected on any side and all sides without limitation.

The invention contains a universal function that is not restricted by a base or a supporting pole system and may be mounted over and anchored to any suitable frame (not shown).

Figure 1:
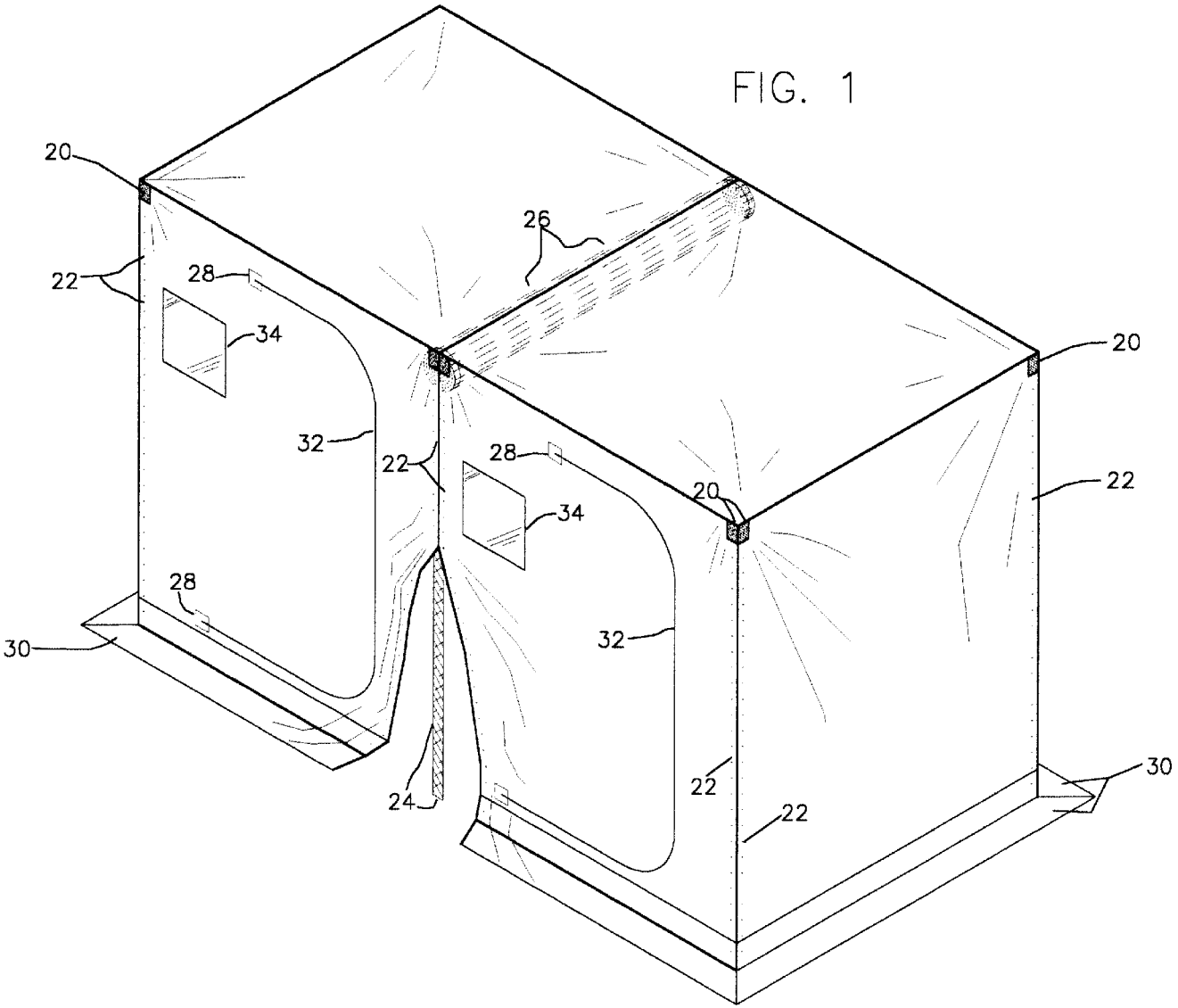
FIG. 1 is a perspective view of two shelters' shells partially connected
Figure 2:
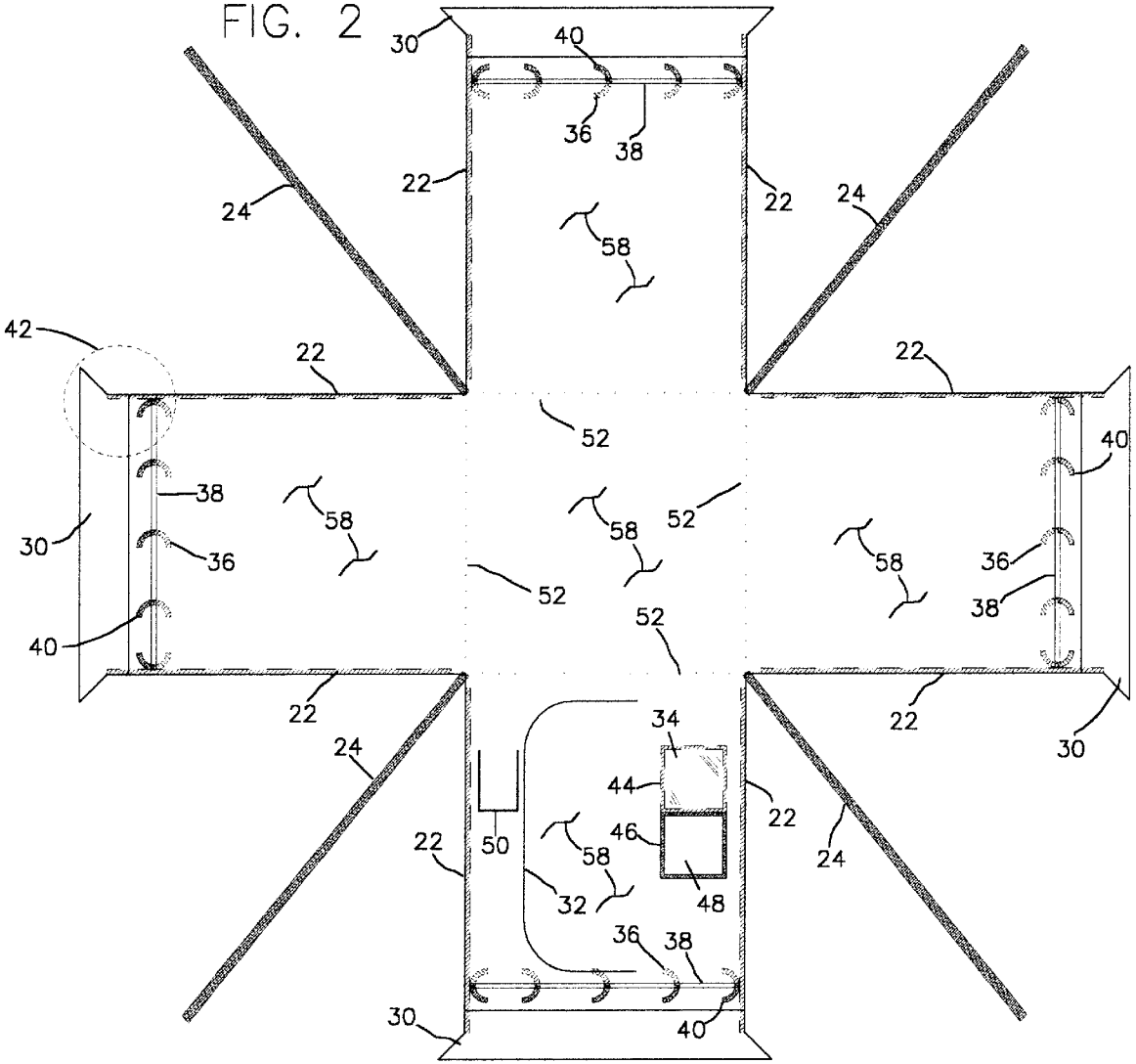
FIG. 2 is a plan view of the shell with all corners detached showing inside of shell.

FIG. 1 is a perspective view of two partially connected shells and FIG. 2 a plan view of the inside of a single shell. The principal component of the shell is a flexible covering 58 of fabric material. Flexible covering 58 as shown in FIG. 2 is in the general shape of a plus sign having a square central portion which forms the top of said shell and four legs which form the side panels or walls of said shell. Flexible covering 58 is dimensioned so that the top of said shell and the walls of said shell are commensurate (slightly greater) than the respective dimensions of said suitable frame (not shown) that supports said shell so as to form an unconnected enclosure or shell depicted in the foreground of FIG. 6. To fully utilize the modular system, all four walls of said flexible covering 58 ought to be the generally of the same dimension. It will be appreciated that the dimensions of flexible covering 58 are not critical. In FIG. 2 flexible covering 58 has all four side panels stitched to the top side of said shell by a seam for top side 52. The seamstress may want to eliminate two of the seam for top side 52 connections by using one length of fabric to form the central portion and the two opposing side panels of said flexible covering 58. The material used in constructing flexible covering 58 may be changed depending upon said shell's intended use; for example if said shell is being used mainly for ice fishing the material ought to be fire retardant, of dark color, opaque, wind resistant and water resistant. Individual side panels (not shown) of a completely different material than that of the shell's flexible covering 58 could attached to the shell to replace the surface of a displaced single wall 56 shown in FIG. 4.

With reference again to FIG. 2 and FIG. 1 a tail fastener 24 preferably manufactured of hook/loop fastening material is permanently connected at one end to each of the top four corners of the interior of said flexible covering 58. Tail fastener 24 is dimensioned to be commensurate with the height of said shell.

A wall fastener 22 manufactured of hook/loop fastening material is permanently attached to each interior vertical edge of the side panels of said flexible covering 58 (note: if said tail fastener 24 is made from hook then said wall fastener 22 needs to be made of loop). Said wall fastener 22 is dimensioned to generally extend the height of said shell with a width dimension that is generally half the width of said tail fastener 24. To reduce steps in the manufacturing process the preferred method of permanently attaching wall fastener 22 to flexible covering 58 is to double stitch it while at the same time making the hem for flexible covering 58.

Referring to FIG. 4 and FIG. 5 a square fastener 20 manufactured of hook/loop fastening material is permanently attached to the upper corners of said flexible covering 58 (note if said wall fastener 22 is made from loop then said square fastener 20 needs to be made of hook).

A reinforcement strip 38 is permanently attached generally near the base or bottom of the interior of said flexible covering 58 as shown in FIG. 2 and FIG. 4. Reinforcement strip 38 and a weather flap 30 may be sewn onto flexible wall covering 58 at the same time and at the same vertical location to save time. The vertical placement of said reinforcement strip 38 will vary with said suitable frame (not shown) that is used. Likewise a anchor strap (hook) 36 and a complementary anchor strap (loop) 40 is stitched to said reinforcement strip 38 as shown in FIG. 2, FIG. 3 and FIG. 4. Said weather flap 30 manufactured of durable weather proof and water repellent material should extend vertically up the side panel of said flexible covering 58 a preferred distance and outward from said shelter a preferred distance.

A window 34 may be placed virtually in any location on said flexible covering 58 as desired and is of a preferred dimension. FIG. 2 shows a loop strip for window shutter 44 attached to flexible covering 58 and framing said window 34. A window shutter 48 is also attached to said flexible covering 58 at the bottom of window 34 and is framed by a hook strip for window shutter 46. Said hook strip for window shutter 46 and said loop strip for window shutter 44 are manufactured of hook/loop fastening material and compliment one another.

FIG. 2 shows a mesh pocket 50 of a preferred dimension that may be placed virtually anywhere on said flexible covering 58. A zipper 32 forms a doorway into and out of said shell and is shown with a square reinforcement 28 sewn into said flexible covering 58 at each end of said zipper 32. It is likely that the vertical edges that can be opened or closed between said tail fastener 24 and said wall fastener 22 at all of the shelters corners will eventually eliminate said zipper 32 and square reinforcement 28 thereby freeing up more space on said shell for features such as mesh pocket 50, window 34 and the like.

PREFERRED EMBODIMENT—OPERATION

FIG. 1 shows two shells partially connected together. Connecting shells together can be done easily by positioning shelters so they face one another and so exterior faces of the walls to be connected together of said shells are generally in the same plane as one another. Once this is done connecting one shelter to another or a group of shelters as illustrated in FIG. 1, FIG. 4 and FIG. 6 can be done from the outside or completely from within the shells. Simply find the corner of the shelter and pull the respective wall fastener 22 free from respective tail fastener 24 on each the walls to be displaced. Once the walls to be moved out of the way are free, the two shelters can be combined by simply attaching wall fastener 22 from each of the walls to be joined to the adjacent half of a shared tail fastener 24. This is best shown in FIG. 1 that reveals a portion of tail fastener 24 that is being shared between the two shelters near the top of said shells which is not visible and a portion of tail fastener 24 near the bottom of said shells that is visible and in position to be fastened to the respective wall fastener 22 to complete the simplified weather tight connection between the two shells. As shown in FIG. 1 tail fastener 24 that is anchored to the top of the shell hangs generally vertically downward and in position to make connection as do wall fasteners 22 thus making the connection easy to find. This system is also easy to use even with gloved hands since the user only need to grab a wall fastener 22 near the top of the shelter with one hand and the respective tail fastener 24 at generally the same vertical location and put said wall fastener 22 in contact with tail fastener 24 and slide both hands down the fastening system while maintaining contact and alignment until the bottom of said shelter is reached thus completing the union of the two walls of the connected shells. Roll connection 26 shows the displaced walls of the connected shelters can be completely rolled up and moved completely out of the way with no restriction as to form a single larger room. An alternative would be to flip the displaced walls on to the exterior top of the connected shelters (not shown). FIG. 1 also best shows that when two respective wall fasteners are connected to each respective half of tail fastener 24 none of the fastening material is exposed to the exterior of the shell affording protection from collecting debris and preserving the integrity of the shells connective properties.

To use as a windbreak, displace wall fastener (22) free from the tail fastener (24) as previously described and secure said displaced single wall 56 to square fastener 20 as shown in FIG. 4 and FIG. 5.

Once displaced single wall 56 is in position as shown in FIG. 4 and FIG. 5 said individual side panel that is of similar design and dimension to side panel of said shell can be attached to the shell to fill the void left by displaced wall 56. This characteristic allows one shelter to function in various fields. For example the opaque flexible covering 58 for ice fishing could have a wall or walls displaced with a hunting screen thus allowing the shell to be used for fishing and hunting.

FIG. 6 shows nine outdoor modular shelter shells connected with the simplified connection system best illustrating the shells aesthetically pleasing, efficient, weather tight joint.

CONCLUSIONS, RAMIFICATIONS, AND SCOPE

Accordingly, it can be seen that this universal and modular shell for a temporary shelter can easily and quickly connect with another like temporary shelter. Also, it can be seen that displacing a wall can have equal or greater value in certain conditions. All of which provides a myriad of opportunities and benefits in doing so, whether it is while camping, hunting, fishing, or working in a construction environment. The proposed invention contains a universal function that is not restricted by a base or supporting pole system. Instead, the concentration has been on permitting many opportunities for the user: adding one or more like shelters for more space, adding different walls such as screens or material for sportsmen to shoot an arrow or bullet through, adding a screen for more ventilation, or merely leaving up to provide the most ventilation and visibility as used in a wind breaker. Many of the other components add to this unique design such as a window with a shutter, an adjustable anchor system, and the weather flap to add to its durability against the elements of the environment.

Although the description above contains many specificities, these should not be construed as limiting the scope of the invention but as merely providing illustrations of some of the presently preferred embodiments of this invention. Various other embodiments and ramifications are possible within it's scope. For example, all accessories are not dependant upon a wall: windows can go anywhere: doors may become obsolete or be placed anywhere, zippers may end up various places, anchors may anchor at various lengths or in various places.

Thus the scope of the invention should be determined by the appended claims and their legal equivalents, rather than by the examples given.

What is claimed is:

1. A outdoor modular shelter shell with simplified connection system comprising:

a flexible panel having a central portion dimensioned to overlie a suitable frame and four side panels having opposed edge portions, said side panels extending from said central portion and dimensioned to generally extend the height and width of said suitable frame so as to form an enclosure;

a tail fastener strip manufactured of hook/loop fastening material permanently attached at one end to the corner of the underside of said central portion and dimensioned to generally extend the height of said shell;

a wall fastener strip manufactured of hook/loop fastening material complimenting said tail fastener strip and being permanently attached throughout its length to the interior vertical edge of said side panels and dimensioned to generally extend the height of said shell;

said wall fasteners sandwiching said tail fastener at each of the interior corners of said enclosure;

said wall fastener and said tail fastener are releaseably connectable throughout the height of said shell;

whereby an interior weather tight joint is provided.

2. The outdoor modular shelter shell with improved connection system according to claim 1, wherein said wall fastener has a width that is generally half the width of said tail fastener.

3. A multi-purpose outdoor modular shelter shell with simplified connection system comprising:

a flexible panel having a central portion dimensioned to overlie a suitable frame and four side panels having opposed edge portions, said side panels extending from said central portion and dimensioned to generally extend the height and width of said suitable frame so as to form an enclosure;

a tail fastener strip manufactured of hook/loop fastening material permanently attached at one end to the corner of the underside of said central portion and dimensioned to generally extend the height of said shell;

a wall fastener strip manufactured of hook/loop fastening material complimenting said tail fastener strip and being permanently attached throughout its length to the interior vertical edge of said side panels and dimensioned to generally extend the height of said shell;

said wall fasteners sandwiching said tail fastener at each of the interior corners of said enclosure;

said wall fastener and said tail fastener are releaseably connectable throughout the height of said shell;

an independent side panel having different characteristics than said shell and having similar dimensions and connection properties as the side panels of said shell;

whereby a multipurpose shell is provided.

4. A outdoor modular shelter shell with simplified connection system comprising:

a flexible panel having a central portion dimensioned to overlie a suitable frame and four side panels having opposed edge portions, said side panels extending from said central portion and dimensioned to generally extend the height and width of said suitable frame so as to form an enclosure;

a tail fastener strip manufactured of hook/loop fastening material permanently attached at one end to the corner of the underside of said central portion and dimensioned to generally extend the height of said shell;

a wall fastener strip manufactured of hook/loop fastening material complimenting said tail fastener strip and being permanently attached throughout its length to the interior vertical edge of said side panels and dimensioned to generally extend the height of said shell;

said wall fasteners sandwiching said tail fastener at each of the interior corners of said enclosure;

said wall fastener and said tail fastener are releaseably connectable throughout the height of said shell;

a plurality of similar said shells;

whereby similar said shells can be joined together to form a wide variety of weather proof configurations.

* * * * *